US006832464B2

(12) United States Patent
Wilson et al.

(10) Patent No.: US 6,832,464 B2
(45) Date of Patent: Dec. 21, 2004

(54) PLASTICS PACKAGING

(75) Inventors: Wayne Alexander Wilson, Auckland (NZ); Robert Andrew Butcher, Bromley (GB)

(73) Assignee: AMCOR Packaging Limited, Auckland (NZ)

( * ) Notice: Subject to any disclaimer, the term of this patent is extended or adjusted under 35 U.S.C. 154(b) by 13 days.

(21) Appl. No.: 10/221,696

(22) PCT Filed: May 30, 2001

(86) PCT No.: PCT/NZ01/00103

§ 371 (c)(1),
(2), (4) Date: Sep. 12, 2002

(87) PCT Pub. No.: WO01/92111

PCT Pub. Date: Dec. 6, 2001

(65) Prior Publication Data

US 2003/0040412 A1 Feb. 27, 2003

(30) Foreign Application Priority Data

May 30, 2000 (NZ) ..... 504849
Oct. 19, 2000 (NZ) ..... 507648

(51) Int. Cl.[7] ..... B65B 11/00
(52) U.S. Cl. ..... 53/462; 493/230; 493/233
(58) Field of Search ..... 493/230, 233, 493/237, 232, 238, 223, 227; 53/449, 462, 469, 467; 383/109, 120, 51

(56) References Cited

U.S. PATENT DOCUMENTS 3,958,749 A 5/1976 Goodrich
4,273,549 A 6/1981 Pezzana et al.
4,592,739 A * 6/1986 Ogawa ..... 493/415
4,747,815 A * 5/1988 Benoit et al. ..... 493/194
5,071,400 A * 12/1991 Bennett ..... 493/223
5,226,858 A * 7/1993 Snowdon ..... 493/195
5,934,809 A * 8/1999 Marbler ..... 383/208
6,161,687 A * 12/2000 Hacikyan ..... 206/204
6,312,742 B1 * 11/2001 Wood et al. ..... 426/122
6,332,711 B1 * 12/2001 Inuzuka et al. ..... 383/9
6,457,863 B1 * 10/2002 Vassallo ..... 383/43
6,460,313 B1 * 10/2002 Cooper ..... 53/79
6,626,811 B2 * 9/2003 Leijon ..... 493/230

FOREIGN PATENT DOCUMENTS

| | | |
|---|---|---|
| DE | 29 19 567 | 5/1979 |
| NZ | NZ-233890 | 6/1989 |
| WO | WO 91/07319 | 5/1991 |
| WO | WO 95/20485 | 8/1995 |

* cited by examiner

*Primary Examiner*—Eugene Kim
(74) *Attorney, Agent, or Firm*—Henricks, Slavin & Holmes LLP

(57) ABSTRACT

A plurality of discrete packages (100) are manufactured from an indefinite length of gusseted packaging material (1). Each package (100) has an insert (9) inserted through an incision (8) in the packaging (1) which in use maintains a desired footprint of the package. Gaps (17) in welds (15) joining the bottom of the insert (9) to the packaging material (1) allow air to vent from between the insert (9) and the packaging material (1). Flaps (23) toward the rear of each package (100) join a leading package (100) to a following package (100*a*) by means of longitudinal welds (21) which allow gaps (22) for air to vent during the roll-up process.

6 Claims, 4 Drawing Sheets

PLASTICS PACKAGING

BACKGROUND OF THE INVENTION

In the packaging of bulk materials, various proposals have been put forward and are currently in use. All of these are directed towards facilitating the packaging, storage, transport and/or subsequent discharge of large quantities of materials such as milk powder.

One bulk material package which enables the substantially rectangular shape of the package to be maintained when it is full of the material is that which is marketed under the GAMBO (trade mark). This is described and claimed in New Zealand Patent No. 233890 for example.

The present invention has particular application in its use with a GAMBO(™) bag, but those skilled in the engineering and packaging arts will appreciate that the present invention can find application in improving the manufacture and design of other types of packaging and is not limited to large plastic bags of the GAMBO(™) type specifically.

In large flexible bags such as the GAMBO(™) bag, an insert within the outer film provides for the maintenance of the rectangular shape of the flexible bag when it is filled. However, the provision of such inserts within the outer film has proved difficult or at least time consuming and expensive.

Previous methods of welding these inserts have also allowed air to be entrapped between the insert and outer pack. This has made winding up of a continuous roll impractical.

OBJECT OF THE INVENTION

The present invention, therefore, has as one object to provide a flexible bag having an insert/or a method of manufacturing same, which will overcome or at least alleviate problems in such bags and/or their manufacture, to the present time, or which at least will provide the public with a useful choice.

Further objects will become apparent from the following description.

SUMMARY OF THE INVENTION

According to one aspect of the present invention, there is thus provided flexible packaging of indefinite length providing a plurality of interconnected but separable flexible packages each having a respective insert positioned and secured within an outer flexible film, a transverse slit across a top layer of the outer flexible film defining the commencement of one of the bags providing at least part of the access into the interior of the outer film for the insertion of the insert.

Preferably said indefinite length of flexible packaging material may be gusseted to produce four plies of film, the packaging having substantially transverse incisions through at least three of the said plies leaving one of said plies intact to define the boundaries of a separable individual package having a leading edge and a trailing edge, an insert being provided for each individual package via the incisions and welded to the outer layer by welds running substantially parallel to the sides of the package, an area between the welds being left unsealed to allow air to escape from between the insert and the outer layer as the material, in use, is wound up.

Preferably, the packaging may have a further weld extending substantially parallel and adjacent to the leading edge of the outer layer, one or more further welds extending substantially parallel and adjacent to the trailing edge of the outer layer, and a plurality of further longitudinal welds joining the top gusset trailing edge of each package to the top gusset leading edge of the adjoining package.

Preferably the trailing edge of a leading package is connected to the leading edge of a following package by means of a flap created in one or more of the plies of said leading package proximate the trailing edge of said leading package and positioned or folded to extend between said trailing edge of said leading package and said leading edge of said following package.

According to a further aspect of the present invention, a flexible package is provided as a bag separated from the above defined continuous packaging.

According to a further aspect of the present invention, there is provided a method of forming continuous flexible packaging to provide a plurality of interconnected but separable flexible packages, said method including the transporting of an indefinite length of flexible outer film past a cutting means, moving the cutting means relative to the outer film in cutting only a top portion of the outer film and leaving a bottom portion intact, said method further including the insertion of an insert into the packaging at each slit so formed, providing sealing means to seal across at least part of the slit and in front of the slit to define a closure for an end of a preceding package and further providing securing means to secure said insert in position within the outer film.

According to a further aspect of the present invention, a method as above defined includes a continuous gusseted outer film, the cutting means cutting through three of four plies formed by the gusseting of the continuous film, the method further including the opening out of the film to enable the insertion of the insert and further providing for the re-gusseting of the outer film.

According to a further aspect of the present invention there is provided a method of forming a plurality of flexible packages, the method including:

providing an indefinite length of gusseted flexible packaging forming four plies.

forming transverse welds between the outer edges of the top ply and the outer edges of the second ply and transverse welds between the outer edges of the third ply and the outer edges of the lower ply, said welds extending partially but not entirely across the width of said gussets;

creating an incision adjacent and in front of the transverse welds through at least the top three of the four plies, leaving one ply intact, to define a trailing edge of an individual package in front and a leading edge of an individual package behind;

introducing an insert into the flexible packaging through the incision;

welding the insert to the flexible packaging in a plurality of locations such that in use the bag when filled with product deforms into a required shape, the welds running substantially parallel to the sides of the packages;

welding the insert to the flexible packaging at substantially the leading edge of the insert, the weld extending substantially between and transverse to the first welds;

welding the insert to the flexible packaging at substantially the trailing edge of the insert, the weld extending partially between and transverse to the first welds such that an area between the first welds is left open to allow air to escape from between the insert and the outer layer.

Preferably the welds of the paragraph immediately above may be formed separately.

According to a still further aspect of the present invention, a continuous flexible packaging and/or a flexible package provided as one of a plurality of such packages as part of a continuous flexible packaging of indefinite length and/or a method of manufacturing same are substantially as herein described.

Further aspects of the this invention, which should be considered in all its novel aspects, will become apparent from the following description given by way of example and possible embodiments thereof, and in which reference is made to the accompanying drawings.

DESCRIPTION OF POSSIBLE EMBODIMENTS OF THE INVENTION

Figure 1A:
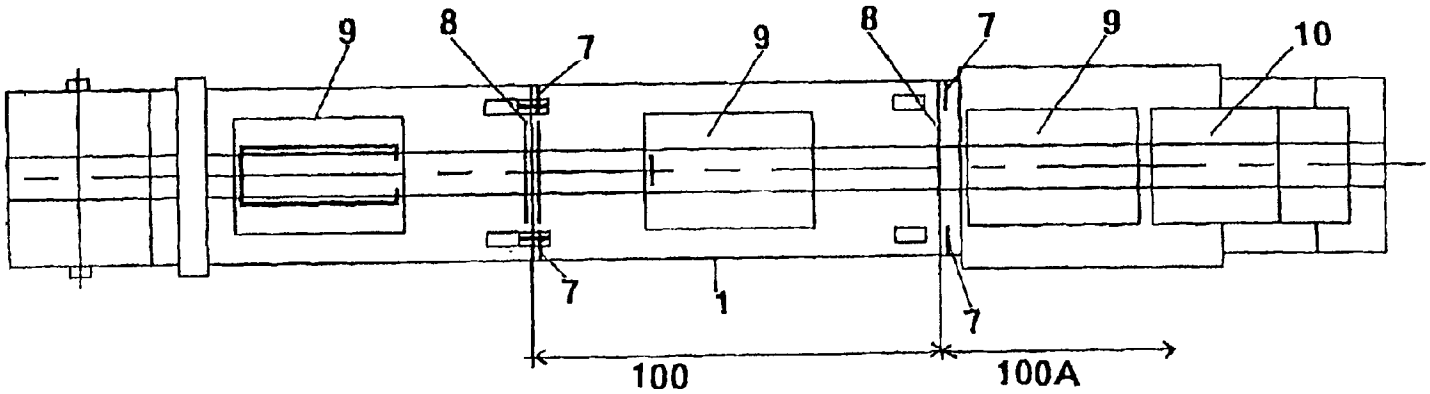
FIGS. 1(*a*) & 1(*b*): Show very diagrammatically a side and plan view respectively of a production line for producing gusseted bulk material packages according to one embodiment of the invention.
Figure 1B:
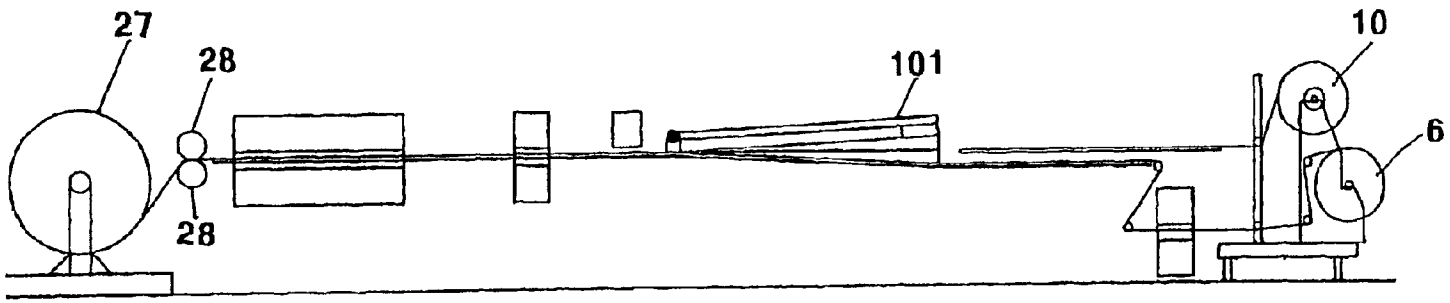
Figure 2:
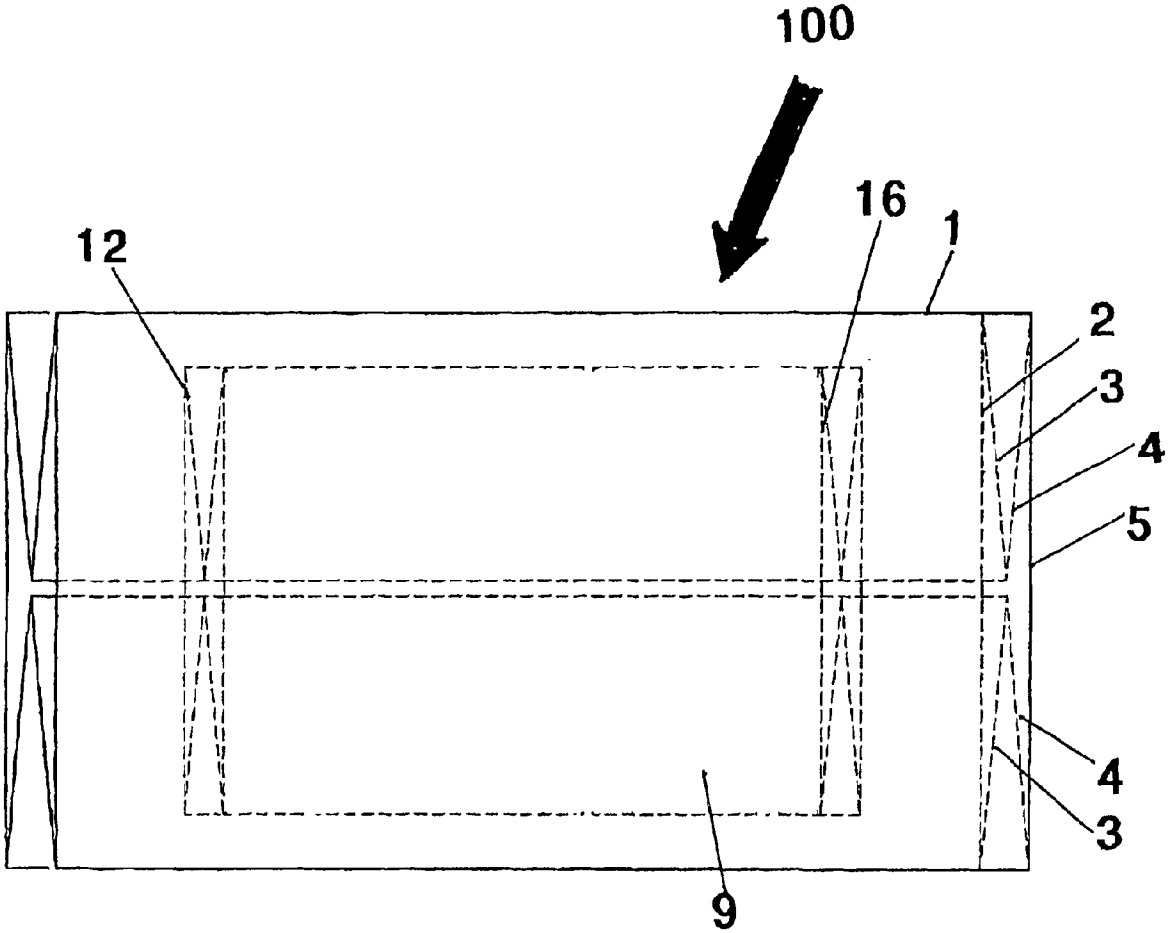
FIG. 2: shows diagrammatically an outer packaging layer with an insert installed and welded.

Referring first to FIGS. 1(*a*), 1(*b*), and 2, in the manufacture of a continuous length of gusseted bulk material packages each generally referenced by arrow 100, a length of gusseted packaging material 1 having four plies 2, 3, 4, 5 unrolls from a bulk spool of packaging material 6. A partial transverse weld 7 is then formed by suitable welding means across gussets 2 and 3 and gussets 4 and 5.

Cutting means create an incision 8 adjacent and in front of the transverse weld 7 through three of the four plies 2, 3, 4 in the packaging material 1, defining a trailing edge of an individual package 100 and the leading edge of the next package 100*a*. Lifting means 101 lift the top three plies 2, 3, 4 of the packaging material 1 and an insert 9 is inserted by suitable means to a required position within the packaging material. The lifting means 101 may include a pneumatically, vacuum or mechanically operated device or lever to lift the plies 2, 3, 4.

Preferably the insert 9 is severed from a continuous roll of suitable insert material 10.

Figure 3:
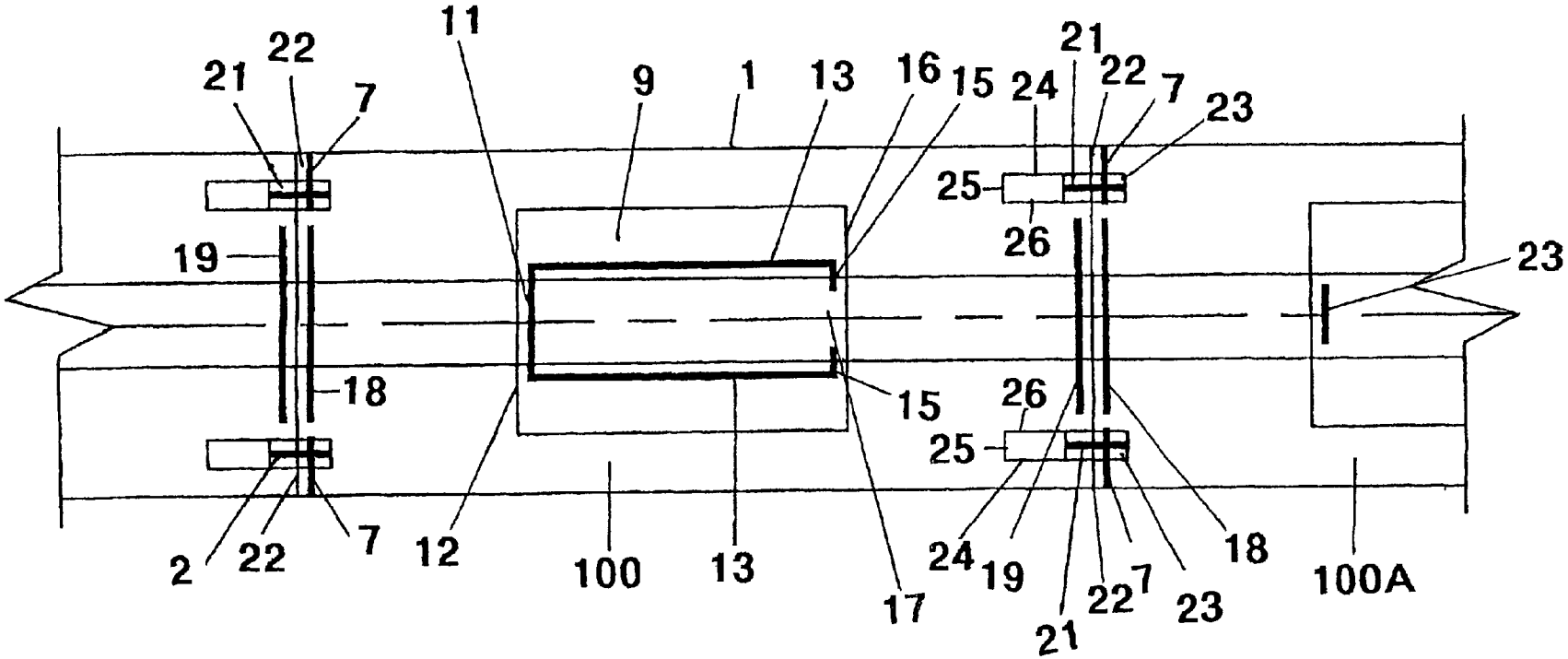
FIG. 3: shows one of a plurality of bulk material packages with an insert installed and welded, including optional welds for sealing feedspouts.
Figure 4:
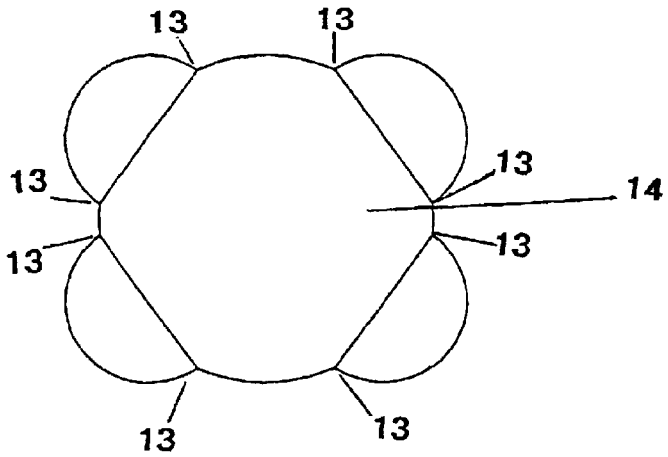
FIG. 4: shows a cross section of an in-use bulk material package of the GAMBO™ type.

Referring next to FIGS. 3 and 4, welding means of any suitable type (not shown) create welds 11 between the insert 9 and the packaging material 1 substantially parallel and adjacent to the leading edge 12 of the insert 9. Welds 13 are also created between the insert 9 and the packaging material 1 substantially parallel to the sides of the packaging material 1, in a suitable position to provide the package 100 with a desired shape 14 when in use, illustrated by way of example in FIG. 4, although it is to be appreciated that the present invention is not limited to GAMBO™ type inserts.

Further welds 15 are created substantially parallel and adjacent to the trailing edge 16 of the insert, with an area 17 left unwelded to allow air entrapped between the insert 9 and the packaging material 1 to escape.

The applications of seals 11, 13 and 15 may be performed simultaneously or sequentially.

Referring particularly to FIG. 3, welding means (not shown) create short longitudinal welds 21 across the outer edges of the incision in the plies forming a weld between the adjoining material while creating an intermediate area 22 for air to vent from the package as it is wound up.

The welds 21 may be formed between the top ply 2 of the package 100 and a separate piece of flexible packaging material, or more preferably, a substantially rectangular flap 23 may be defined by creating three incisions 24, 25, 26 in the top ply 2 in the area proximate the trailing edge of the package 1. The flap 23 may be defined in the area outside that later defined by the feedspout and may be of such position and size as to allow the flap 23 to be folded under the trailing edge of the package 100 and the leading edge of the following package 100*a*. Short longitudinal welds 21 are formed between the flap 23 and the top ply 2 of the package 100, and between the flap 23 and the top ply 2 of the following package 100*a*, thus joining the top plies of the two adjacent packages 100, 100*a*. In this way the top plies of the packages 100, 100*a* may be held together during subsequent operations.

Alternatively a plurality of flaps 23 may be formed by extending incisions 24, 25, 26 through one or more of the lower plies 3, 4, 5.

The packaging is then rolled onto a third roll 27 via nip rollers 28, see FIG. 1(*b*), which squeeze the gusseted layers forcing out entrapped air through the air venting areas 17, 22 described above.

Figure 5B:
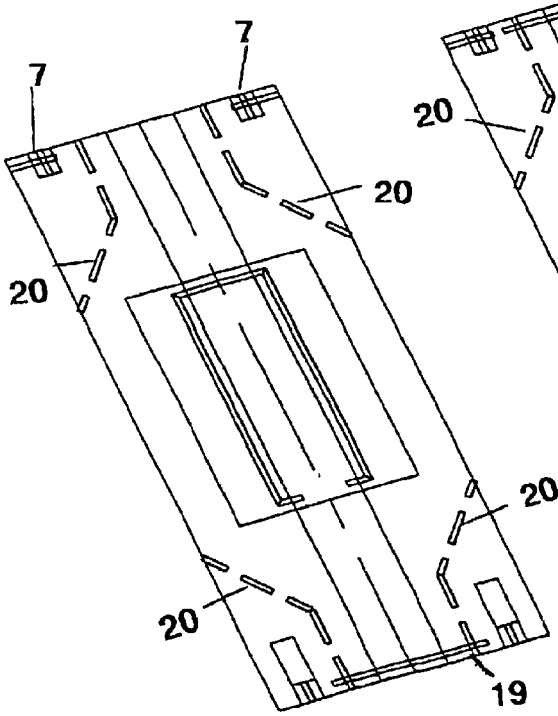
FIGS. 5(*a*) & 5(*b*): shows two possible embodiments of a bulk material package, one with a sealed feedspout and one with a feedspout not sealed.
Figure 5A:
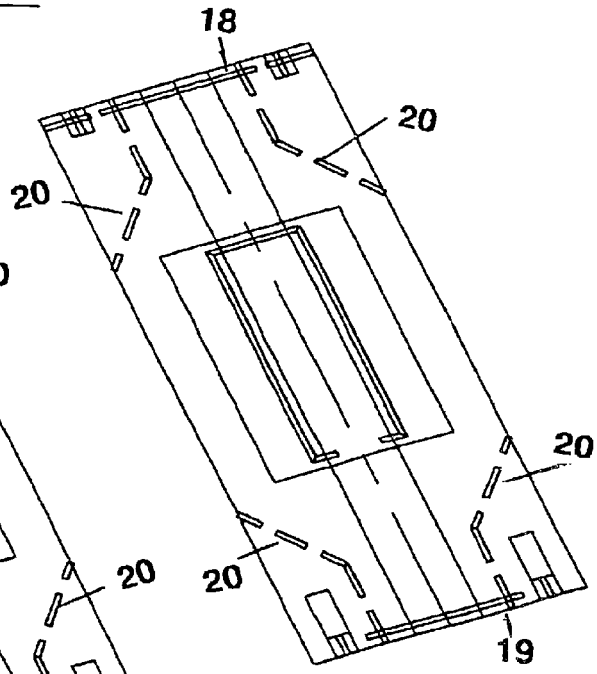

Referring next to FIG. 5(*a*), if a sealed feedspout design is required, welding means create one or more transverse welds 18 substantially adjacent to the leading edge of the package, the welds extending across the middle of the package.

Alternatively, if an open feedspout design is required as in FIG. 5(*b*), welds 7 applied prior to cutting of the plies 2, 3, 4 may be used to define the outer edge of the feedspout. Further welds defining feed and exit spouts 20 are performed by the user.

If a sealed discharge spout is required, welding means create one or more transverse welds 19 substantially adjacent to the trailing edge of the package 100, the welds extending across the middle of the package to close the area defined by the exit of the spout.

Where in the foregoing description, reference has been made to specific components of integers of the invention having known equivalents then such equivalents are herein incorporated as is individually set forth.

Although this invention has been described by way of example and with reference to possible embodiments thereof, it is to be understood that modifications or improvements may be made thereto without departing from the scope or spirit of the invention defined in the appended claims.

What is claimed is:

1. A continuous length of flexible packaging providing a plurality of interconnected but separable flexible packages each having a respective insert positioned and secured within an outer flexible film, wherein for each of at least two adjacent flexible packages, the outer flexible film is gusseted to produce four plies of film, the flexible package including at least one substantially transverse incision through three of the said plies leaving one of said four plies intact to define the boundaries of a separable individual package having a leading edge and a trailing edge, said insert being provided for each individual package via the incisions and welded to the outer flexible film by welds running substantially parallel to the sides of the package, an area between the welds being left unsealed to allow air to escape from between the insert and the outer flexible film as the material, in use, is wound up.

2. The packaging of claim 1 wherein the packaging includes a further weld extending substantially parallel and adjacent to a leading edge of the outer flexible film, one or more further welds extending substantially parallel and adjacent to a trailing edge of the outer flexible film, and a plurality of further longitudinal welds joining a top gusset trailing edge of each package to a top gusset leading edge of the adjoining package.

3. The packaging of claim 1 wherein the trailing edge of a leading package is connected to the leading edge of a following package by means of a flap or flaps created in one or more of the plies of said leading package proximate the trailing edge of said leading package and configured to extend between said trailing edge of said leading package and said leading edge of said following package, the flap or flaps welded to the plies of said packages by longitudinal welds.

4. A method of forming a length of continuous flexible packaging to provide a plurality of interconnected but separable flexible packages, said method including the transporting of a continuous length of flexible outer film past a cutting means, the flexible outer film gusseted to form four plies, the method including the steps of cutting a slit in three of the four plies and leaving a bottom portion intact, said method further including opening out of the outer film to allow the insertion of an insert into the packaging at each slit so formed, re-gusseting the outer film, and providing sealing means to seal across at least part of the slit and in front of the slit to define a closure for an end of a preceding package and further providing securing means to secure said insert in position within the outer film.

5. The method of claim 4 including:

wherein the step of cutting includes the step of cutting three top plies including a top ply, a second ply and a third ply, leaving a lower ply intact, and further including the step of preceding the cutting of the top three plies by forming transverse welds between outer edges of the top ply and outer edges of the second ply and transverse welds between outer edges of the third ply and outer edges of the lower ply, said welds extending partially but not entirely across the width of said gusset;

introducing an insert into the flexible packaging through the slit;

welding the insert to the flexible packaging in a plurality of locations such that in use the bag when filled with product deforms into a desired shape, the welds running substantially parallel to the sides of the packages;

welding the insert to the outer film at substantially the leading edge of the insert, the weld extending substantially between and transverse to the first welds;

welding the insert to the outer film at substantially the trailing edge of the insert, the weld extending partially between and transverse to the first welds such that an area between the first welds is left open to allow air to escape from between the insert and the outer film.

6. The method of claim 4 wherein a trailing edge of the preceding package is connected to a leading edge of a following package by means of a flap or flaps created proximate the trailing edge of said preceding package and positioned to extend between said leading edge and said trailing edge, further comprising the step of welding the flap or flaps to said packages by means of longitudinal welds formed between said flap or flaps and said packages.

* * * * *

UNITED STATES PATENT AND TRADEMARK OFFICE

CERTIFICATE OF CORRECTION

PATENT NO. : 6,832,464 B2
APPLICATION NO. : 10/221696
DATED : December 21, 2004
INVENTOR(S) : Wayne Alexander Wilson and Robert Andrew Butcher It is certified that error appears in the above-identified patent and that said Letters Patent is hereby corrected as shown below:

On title page Item [73]
Change the Assignee of the patent to read:
Insert
AMCOR Packaging (New Zealand) Limited, Signed and Sealed this Eighth Day of January, 2008

JON W. DUDAS
*Director of the United States Patent and Trademark Office*